United States Patent [19]

Hoffman

[11] Patent Number: 4,731,112

[45] Date of Patent: Mar. 15, 1988

[54] METHOD OF PRODUCING FERRO-ALLOYS

[75] Inventor: Glenn E. Hoffman, Pineville, N.C.

[73] Assignee: Midrex International, B.V. Rotterdam, Zurich Branch, Zurich, Switzerland

[21] Appl. No.: 875,126

[22] Filed: Jun. 17, 1986

Related U.S. Application Data

[63] Continuation-in-part of Ser. No. 718,688, Apr. 1, 1985, abandoned.

[30] Foreign Application Priority Data

Feb. 19, 1986 [AU] Australia ..... 53751/86

[51] Int. Cl.[4] ..... C22B 4/00

[52] U.S. Cl. ..... 75/10.22; 75/10.63; 420/123; 420/126; 420/127; 420/590; 420/117

[58] Field of Search ..... 420/581, 583, 117, 590, 420/126, 127, 123; 75/256, 10.22, 10.63

[56] References Cited

U.S. PATENT DOCUMENTS 3,637,370 1/1972 Buker ..... 420/581
4,395,285 7/1983 Merkert ..... 75/256

OTHER PUBLICATIONS

Stlephenson RL Direct Reduced Iron, p. 224, Aug. 1982, TN707D56.

*Primary Examiner*—Melvyn J. Andrews
*Attorney, Agent, or Firm*—Ralph H. Dougherty

[57] ABSTRACT

A method of making a molten ferroalloy product in a melting furnace by charging a briquet consisting essentially of metallized iron, granulated alloy metal oxide, and a carbon source, such as coke breeze, to the melting furnace, burning solid carbonaceous material to reduce the alloy metal oxide to metallized form and to heat the charge to form a molten ferroalloy product. Fluxes and slag formers are also charged to the furnace as required.

5 Claims, No Drawings

METHOD OF PRODUCING FERRO-ALLOYS

CROSS REFERENCE TO RELATED APPLICATION

This application is a continuation-in-part application of copending U.S. patent Application Ser. No. 718,688, filed Apr. 1, 1985, now abandoned.

BACKGROUND OF THE INVENTION

The present invention relates to alloys having a metallic iron content for use in the manufacture of iron and steel as well as the method of making such alloys.

In the manufacture of iron and steel, it is customary to make certain additions to the melting furnace such as various metalliferous products in the form of alloys such as ferrosilicon, ferronickel, ferrochrome, ferromanganese, and the like. Such ferroalloys normally contain a substantial amount of carbon. In the present invention, metallized iron, the alloy element in oxide form, and carbon are formed into a compact, or briquet, then charged into a shaft furnace along with additional carbonaceous material such as coke, if necessary, and reduced to form a molten ferroalloy product of high value for foundry practice and other iron and steelmaking uses.

"Metallized iron", as used throughout this specification does not mean coated with iron metal, but means substantially completely reduced to the metallic iron state, i.e., always in excess of 60% of the total iron is present in metallic form, with the remainder of the iron being present in the oxide form, but usually in excess of 80% of the total iron in the material is present as metal. Such metallized iron in many forms, including pellets, is well suited as feed material to steelmaking furnaces such as an electric arc furnace.

The briquet to be charged to the shaft furnace preferably employs metallized iron fines as the basic ingredient in its composition. Previously known briquets employ iron oxide fines. The presence of metallized fines reduces the energy requirement for the invented process. Since the iron fines are in the metallized condition, the energy normally required for reducing iron oxide to iron is not a requirement in this process. Since the iron in the briquet need not be reduced before melting, the energy requirement is reduced.

The closest known prior art patents include Rehder U.S. Pat. No. 4,179,283, Merkert U.S. Pat. No. 4,395,284, Strange U.S. Pat. No. 4,369,062, Gustaffson U.S. Pat. No. 2,010,230, and Querengasser, et al. U.S. Pat. No. 3,431,103.

Rehder teaches the briquetting of metal oxides only and has no direct reduced iron in his briquet charge. He utilizes two sources of carbon, a high reactivity and a low reactivity carbon.

Merkert teaches that iron and a binder are optional and are not essential ingredients. He prepares porous compacts for use as a feed material to an electric furnace, the material having an apparent low density and high internal porosity. Merkert states that up to about 15% of the silica weight can be iron particles, however, this is identified as mill scale, which is generally in oxide form.

Strange teaches production of a briquet from reclaimed materials, such as iron fines and mill scale up to 41%. A study has shown that he has insufficient carbon in his briquet to reduce the mill scale. He also requires an additional source of energy to provide heat during the melt.

Gustafsson teaches use of a thermit reducing agent, which provides both reduction and heat, and increases cost of operation of the process, and further uses insufficient carbon to effect complete reduction of iron oxide, whereas the present invention utilizes carbon as a reducing agent, and provides heat in a more economical manner.

Querengasser requires a critical combination of coal with a caking capacity of 4 to 10, and non-caking coal or coke. In addition, Querengasser states that ferrosilicon is made from iron turnings or chips, quartz, and carbon. He states also that iron oxide is less suitable than iron turnings or chips for making high grade ferrosilicon.

The present invention differs from each of these prior art teachings in that the charged briquets contain the desired alloy metal in oxide form, carbon, and iron which is from 60% to 97% metallized.

OBJECT OF THE INVENTION

It is the principal object of this invention to provide a method for making a ferroalloy more economically than is presently possible, for various steelmaking and foundry practices.

SUMMARY OF THE INVENTION

A mixture of finely divided material consisting essentially of 50 to 88 percent metallized iron, 7 to 35 percent alloy oxide, and 5 to 15 percent carbon, no more than 3.5 percent impurities, and compacted to form a briquet. A binder may be used, if desired. The briquet is charged into a shaft furnace along with additional carbonaceous material, which is burned to heat and reduce the alloy oxide to metallized form, melt the iron and alloying element, and form a ferroalloy melt in the furnace.

DETAILED DESCRIPTION

The invented process utilizes as a charge material an iron bearing briquet consisting essentially of from about 50 to 88% metallized iron, from about 7 to about 35% alloy in metal oxide form, and from about 5 to about 15% carbon. The iron in the composition is in the form of metallized iron fines, preferably made by direct reduction of iron oxide, which are at least 60% metallized, but usually in the range of 80% to 97% metallized.

A more advantageous range of components in the briquet is from 50 to 70% metallized iron, 15 to 35% alloy oxide and 9 to 15% carbon.

All of these components should be in the finely divided form, preferably minus 3 millimeters.

Silica, manganese oxide, chromite, molybdenum oxide, nickel oxide, cobalt oxide, vanadium oxide, or other desired alloy oxide is present in fine or granulated form. Such oxides are herein given the formula $MO_x$ for ease of notation in equations.

The metallized iron fines within the briquet melt to form discrete iron droplets which are saturated with carbon. The carbon is preferably a component of a solid fuel, such as coal or coke, or alternatively could be pitch or tar. The briquet should include additional carbon beyond the stoichiometric requirements in order to have a portion act as fuel to provide the heat of reaction for reduction and supply the necessary energy to heat and melt the reduced iron and silicon to tapping temperature (about 2700° F. or 1500° C.). The function of carbon in the briquet is:

(1) to supply the energy required for the heat of reaction to reduce the alloy metal oxide species, the reaction being;

$$MO_x + \underline{C} \xrightarrow{heat} M_{(s)} + CO$$

(2) to supply the energy required to dissolve the carbon into the molten iron, the reaction being;

$$C_{(s)} \xrightarrow{heat} \underline{C}$$

(3) to provide the energy required to satisfy the enthalpy requirement in heating the iron and metallized oxide species (after reduction) to tapping temperature; and (4) to provide the energy to dissolve the reduced metal species into the molten iron, the reaction being;

$$M_{(s)} \xrightarrow{heat} \underline{M}$$

Preferably, the particle size of all components is less than 3 millimeters prior to briquetting.

The mixture set forth above can be briquetted by hot briquetting at a temperature of at least 600° C. and a pressure of at least 1,000 pounds per square inch to form a hot iron-bearing briquet.

In the operation of the invented process, the ferroalloy briquet is charged into a shaft furnace melter, such as a cupola or other melting furnace. A substantial portion of the alloy oxide in the briquet will be reduced during the melting process, and the metallic alloy element will become available to the molten product as an alloying element. Thus it is seen that the ferroalloy briquets can be substituted for the more expensive ferrosilicon or other ferroalloy.

In a cupola furnace, which is a melting furnace and not a reduction furnace, a loss in melting productivity results when reduction of both alloy oxide and iron oxide must be performed in the furnace. When only the alloy oxide must be reduced, that is if the iron oxide has already been reduced to the metallized iron form, the loss in melting productivity is minimized.

Oxygen for combustion in the cupola is provided by preheated air, with optional oxygen enrichment. The cupola could be a conventional coke cupola, or a cokeless cupola, or any desired melting furnace, which could be fired by oxy-fuel burners, oxygen enriched air/natural gas burners, plasma torches, or electrodes such as carbon arc electrodes in an electric arc furnace.

The briquet charged preferably consists essentially of metallized iron fines, fine or granulated alloy in oxide form, and a carbon source such as coke breeze or coal fines.

Sufficient additional carbon, in the form of solid carbonaceous material such as coke, is charged to the melting furnace in such quantity that it will satisfy the enthalpy and heat of fusion requirements to melt the solid iron, solid iron alloy, and slag formers that have been charged to the melter, as well as provide carbon to the extent of being partially oxidized to form a non-oxidizing atmosphere in the melting zone of the melter to protect the iron and any reduced alloy specie against oxidation.

The following tables compare the chemical analyses of various ferrosilicon compositions with equivalent ferrosilica briquets, as used in the present invention.

TABLE I

| Ferrosilicon Designation | Ferrosilicon Analysis FeSi 5 | FeSi 10 | FeSi 25 |
|---|---|---|---|
| Fe | 94.5% | 89.5% | 74.5% |
| Si | 5.0 | 10.0 | 25.0 |
| C | 0.5 | 0.5 | 0.5 |

TABLE II

| Ferrosilicon Equivalent | Ferrosilica Briquet Composition FeSi 5 | FeSi 10 | FeSi 25 |
|---|---|---|---|
| Metallized Iron Fines | 86.7% | 75.9% | 51.6% |
| $SiO_2$ | 7.8 | 15.7 | 33.5 |
| C | 5.5 | 8.4 | 14.9 |

TABLE III

| | Ferrosilica Briquet Analysis FeSi 5 | FeSi 10 | FeSi 25 |
|---|---|---|---|
| Fe | 73.5% | 64.4% | 43.7% |
| FeO | 8.3 | 7.3 | 4.9 |
| C | 6.8 | 9.5 | 15.7 |
| $SiO_2$ | 9.1 | 16.8 | 34.3 |
| CaO | 0.8 | 0.7 | 0.5 |
| Other | 1.5 | 1.3 | 0.9 |

Table III clearly shows that the other components of the briquet besides the principal components, iron, carbon, and alloy oxide, varies from 1.4 to 2.3 percent. The range of other components, such as lime, titania, phosphorus compounds, sulfur, and gangue, that can be tolerated in the invented briquet is from about 0.8 to about 3.5 percent.

ALTERNATIVE EMBODIMENTS

The charge to the cupola could be a mixture of briquets, hot briquetted iron, plain carbon steel scrap, alloy steel scrap, reclaimed cast iron, and coke.

Flux additions such as limestone, burned lime, dolomitic lime, spar, and the like would be utilized to form a suitable slag for either desulfurization, dephosphorization, or both, or just to flux impurities from the melt to the slag.

The molten ferroalloy product could be granulated, or cast into pigs or small ingots.

SUMMARY OF THE ACHIEVEMENT OF THE OBJECT OF THE INVENTION

From the foregoing description, it is readily apparent that I have invented a process for making molten ferroalloys which is more economical than is presently possible, for various steelmaking and foundry practices.

It is also apparent that modifications may be made without departing from the spirit of the invention and no limitations are to be inferred except as specifically set forth in the appended claims.

What is claimed is:

1. A method of producing a ferro-alloy comprising:

forming compacts consisting essentially of a mixture of from 50% to 88% metallized direct reduced iron fines which fines are from 60% to 97% metallized, from 5% to 15% solid carbonaceous material, and from 7% to 35% of an oxide of a metal selected from the group consisting of, silicon, nickel, chromium, manganese, titanium, vanadium, molybdenum, and cobalt;

charging only said compacts, additional solid carbonaceous material to provide additional heat and reactive carbon, and slag formers to a melting furnace; and burning said solid carbonaceous material to reduce the oxides in said compacts, to melt the constituents, and to form a high alloy melt.

2. A method according to claim 1, further comprising charging solid iron, iron alloy, hot briquetted iron, carbon steel scrap, alloy steel scrap, reclaimed cast iron, or a mixture thereof to said melting furnace.

3. A method according to claim 1, further comprising injecting oxygen into said furnace to aid combustion.

4. A method according to claim 1, wherein said oxygen is present in the form of preheated air.

5. A method according to claim 1, further comprising providing heat to said furnace by oxy-fuel burners, oxygen enriched air/natural gas burners, plasma torches, or electrodes.

* * * * *